US009885307B2

(12) United States Patent
Yamaguchi et al.

(10) Patent No.: US 9,885,307 B2
(45) Date of Patent: Feb. 6, 2018

(54) CONTROL APPARATUS FOR INTERNAL COMBUSTION ENGINE

(75) Inventors: Yuji Yamaguchi, Toyota (JP); Norihisa Nakagawa, Toyota (JP); Shuntaro Okazaki, Toyota (JP)

(73) Assignee: Toyota Jidosha Kabushiki Kaisha, Toyota-shi, Aichi (JP)

( * ) Notice: Subject to any disclaimer, the term of this patent is extended or adjusted under 35 U.S.C. 154(b) by 474 days.

(21) Appl. No.: 14/390,234

(22) PCT Filed: Apr. 10, 2012

(86) PCT No.: PCT/JP2012/059812

§ 371 (c)(1),
(2), (4) Date: Oct. 2, 2014

(87) PCT Pub. No.: WO2013/153626

PCT Pub. Date: Oct. 17, 2013

(65) Prior Publication Data

US 2015/0120170 A1 Apr. 30, 2015

(51) Int. Cl.
*F02D 41/30* (2006.01)
*F02D 41/14* (2006.01)

(52) U.S. Cl.
CPC ..... *F02D 41/30* (2013.01); *F02D 41/1401* (2013.01); *F02D 41/1441* (2013.01); *F02D 41/1477* (2013.01); *F02D 2041/1422* (2013.01)

(58) Field of Classification Search
CPC .. F02D 41/30; F02D 41/1401; F02D 41/1477; F02D 41/1441; F02D 2041/1422
See application file for complete search history.

(56) References Cited

U.S. PATENT DOCUMENTS 8,650,943 B2 * 2/2014 Kimura ..... F02B 75/041 73/114.72
9,145,804 B2 * 9/2015 Nakagawa ..... F02D 41/1441
2013/0275024 A1 * 10/2013 Nakagawa ..... F02D 41/1441 701/102

FOREIGN PATENT DOCUMENTS

JP 2009-281328 12/2009
JP 2011-117341 6/2011
WO WO 2011024324 A1 * 3/2011 ..... F02B 75/041

* cited by examiner

*Primary Examiner* — David Hamaoui
(74) *Attorney, Agent, or Firm* — Finnegan, Henderson, Farabow, Garrett & Dunner, LLP

(57) ABSTRACT

Invention suppresses deterioration of emission if there is air-fuel ratio imbalance among cylinders. Apparatus (100) controlling an engine including first and second air-fuel ratio sensors respectively disposed on upstream and downstream of catalyst, has: first determining device determining first F/B controlled variable according to deviation between output value and target value of first air-fuel ratio sensor; second determining device determining second F/B controlled variable according to deviation between output value and target value of second air-fuel ratio sensor; controlling device controlling fuel injection amount based on first and second F/B controlled variables; detecting device detecting air-fuel ratio imbalance among cylinders; and correcting device correcting second F/B controlled variable in direction in which there is hardly change of fuel injection amount to lean air-fuel ratio side, according to output deviation between first and second air-fuel ratio sensors, if air-fuel ratio imbalance is detected.

9 Claims, 4 Drawing Sheets

CONTROL APPARATUS FOR INTERNAL COMBUSTION ENGINE

CROSS-REFERENCE TO RELATED APPLICATIONS

This application is a national phase application of International Application No. PCT/JP2012/059812, filed Apr. 10, 2012, the content of which is incorporated herein by reference.

TECHNICAL FIELD

The present invention relates to a control apparatus for an internal combustion engine, configured to suppress emission deterioration due to air-fuel ratio imbalance among cylinders, in the internal combustion engine provided with an exhaust gas purifying catalyst.

BACKGROUND ART

As this type of apparatus, there is an apparatus using an exhaust gas system which is provided with a first air-fuel ratio sensor without a catalyst layer and a second air-fuel ratio sensor with a catalyst layer on the upstream of a catalyst disposed in an exhaust system (refer to Patent Literature 1). According to an apparatus which detects an abnormality of a variation of air-fuel ratio among cylinders disclosed in the Patent Literature 1, in the exhaust gas system, a shift of the output value of the first air-fuel ratio sensor to a rich air-fuel ratio side due to hydrogen caused by a variation of the air-fuel ratio among cylinders (i.e. the air-fuel ratio imbalance) is determined on the basis of difference between the outputs of the two sensors. It is therefore considered that the abnormality of the variation of the air-fuel ratio among cylinders is accurately detected with little influence of noise.

Moreover, the Patent Literature also discloses such a configuration that the output of the first air-fuel ratio sensor is corrected on the basis of output peaks of the first air-fuel ratio sensor and the second air-fuel ratio sensor.

There is also proposed such an apparatus which is provided with sensors configured to obtain air-fuel ratios on the upstream and downstream of a catalyst and which is configured to set a correction amount on the basis of a difference between a downstream air-fuel ratio target and a sensor output while allowing that a F/B correction amount by the downstream sensor is beyond a guard range (e.g. refer to Patent Literature 2).

CITATION LIST

Patent Literatures

Patent Literature 1: Japanese Patent Application Laid Open No. 2009-281328
Patent Literature 2: Japanese Patent Application Laid Open No. 2011-117341

SUMMARY OF INVENTION

Technical Problem

If there is the air-fuel ratio imbalance among the cylinders, hydrogen ($H_2$) is generated in the cylinder on the rich air-fuel ratio side. The hydrogen has a higher diffusion rate than those of other gas elements in an exhaust gas, and the A/F (air-fuel ratio) sensor thus easily detects the air-fuel ratio of a gas which is a detection target as a richer (i.e. lower) value than an actual air-fuel ratio.

According to the apparatus disclosed in the Patent Literature 1, the second air-fuel ratio sensor is provided with the catalyst layer, and hydrogen is consumed due to a reaction in the catalyst layer. It is thus considered that the output value of the second air-fuel ratio sensor is not influenced by the hydrogen. Therefore, the logic is that the extent of a deviation between a detection value of the first air-fuel ratio sensor and the actual air-fuel ratio can be estimated from the difference of the outputs of two sensors.

The apparatus disclosed in the Patent Literature 1, however, has the following problem. The catalyst layer of the second air-fuel ratio sensor has an exhaust gas purification function but it is nevertheless a small-scaled and simple catalyst attached to the sensor, and there is a difference in the exhaust gas purification function in comparison with a so-called exhaust gas purifying catalyst such as a three-way catalyst which can be normally provided for an exhaust passage of an internal combustion engine.

Therefore, although the hydrogen is purified by the catalyst layer theoretically to some extent, it is extremely hard for the second air-fuel ratio sensor to accurately detect the air-fuel ratio of the exhaust gas. In other words, the output value of the second air-fuel ratio sensor is insufficient as a reference value in correcting the output value of the first air-fuel ratio sensor.

Moreover, in addition to the problem described above, in the apparatus disclosed in the Patent Literature 1, the air-fuel ratio state of a gas (or a catalyst emission gas) after passing through the exhaust gas purifying catalyst located on the downstream side of the two air-fuel ratio sensors is detected by an oxygen concentration sensor having so-called Z characteristics in which the output value is inverted at a theoretical air-fuel ratio. Since this type of oxygen concentration sensor can detect the air-fuel ratio only in the vicinity of the theoretical air-fuel ratio, it is hard to use an output value of the oxygen concentration sensor for the correction of the output value of the air-fuel ratio sensor on the upstream of the catalyst which is influenced by the hydrogen.

Moreover, in the configuration described above, for the same reason, the air-fuel ratio within the catalyst is also hardly accurately maintained at the air-fuel ratio as the target. Therefore, it is hard to correct the deviation of the output value of the air-fuel ratio sensor on the upstream of the catalyst to the rich side with respect to the actual air-fuel ratio (hereinafter expressed as a "rich shift" as occasion demands), and it is also extremely hard to provide desired exhaust gas purification characteristics to an entire exhaust gas purification system. This type of problem can also occur in the same manner in the apparatus disclosed in the Patent Literature 2.

As described above, in the conventional technology including the apparatuses disclosed in the aforementioned Patent Literatures, there is concern that the exhaust gas purification performance of the exhaust gas purification system is disturbed to deteriorate emission of the internal combustion engine if there is the air-fuel ratio imbalance among the cylinders.

In view of the aforementioned concern, it is therefore an object of the present invention to provide a control apparatus for an internal combustion engine, configured to suppress the deterioration of the emission if there is the air-fuel ratio imbalance among the cylinders.

Solution to Problem

In order to solve the above described problem, a control apparatus for an internal combustion engine of the present invention is a control apparatus for an internal combustion engine, configured to control the internal combustion engine, the internal combustion engine is provided with: an exhaust gas purifying catalyst disposed in an exhaust passage; a first air-fuel ratio sensor disposed on an upstream side of the catalyst and configured to output a first output value according to an air-fuel ratio of a catalyst inflow gas; and a second air-fuel ratio sensor disposed on a downstream side of the catalyst and configured to output a second output value according to an air-fuel ratio of a catalyst emission gas, the control apparatus is provided with: a first determining device configured to determine a first F/B controlled variable for making the first output value converge on a first target value, according to a first deviation which is a deviation between the first output value and the first target value; a second determining device configured to determine a second F/B controlled variable for making the second output value converge on a second target value, according to a second deviation which is a deviation between the second output value and the second target value; a controlling device configured to control a fuel injection amount of the internal combustion engine on the basis of the determined first F/B controlled variable and the determined second F/B controlled variable; a detecting device configured to detect air-fuel ratio imbalance among a plurality of cylinders of the internal combustion engine; and a correcting device configured to correct the second F/B controlled variable in a direction in which there is hardly a change of the fuel injection amount to a lean air-fuel ratio side, according to an output deviation between the first air-fuel ratio sensor and the second air-fuel ratio sensor, if the air-fuel ratio imbalance is detected (First Item).

Each of the first and second air-fuel ratio sensors of the present invention is configured, for example, as a linear air-fuel ratio sensor having practically sufficient air-fuel ratio detectability in a wide air-fuel ratio region including an air-fuel ratio on a richer side and a leaner side from the theoretical air-fuel ratio. In other words, the second air-fuel ratio sensor on the downstream side of the catalyst is different from an oxygen concentration sensor having so-called Z characteristics, which can only determine in a binary manner whether or not the air-fuel ratio is on the rich side (or a low side) or on the lean side (or a high side) with respect to the theoretical air-fuel ratio. The "output value" of the sensors in the present invention, however, may be various according to the configuration of the sensors. For example, the output value may be a voltage value which varies to be high or low according to a high or low air-fuel ratio, or may be a voltage value which varies to be low or high according to a high or low air-fuel ratio. Moreover, the output value is not necessarily the voltage value.

According to the control apparatus for the internal combustion engine of the present invention, the fuel injection amount is controlled by the controlling device on the basis of the first F/B controlled variable determined by the first determining device and the second F/B controlled variable determined by the second determining device.

The first F/B controlled variable conceptually includes controlled variables of various feedback (F/B) controls (e.g. PID control, PI control, etc.) for making the first output value converge on the first target value, which are performed according to a deviation (the first deviation) between an output value of the first air-fuel ratio sensor (the first output value) and a target value thereof (the first target value). For example, the first F/B controlled variable may be a controlled variable which is obtained by multiplying the first deviation by a predetermined F/B gain or by similar calculations, and which is used for various arithmetic operations (e.g. the arithmetic of addition, subtraction, multiplication and division) with a basic fuel injection amount.

The second F/B controlled variable conceptually includes controlled variables of various feedback (F/B) controls (e.g. PID control, PI control, etc.) for making the second output value converge on the second target value, which are performed according to a deviation (the 15 second deviation) between an output value of the second air-fuel ratio sensor (the second output value) and a target value thereof (the second target value). For example, the second F/B controlled variable may be a controlled variable which is obtained by multiplying the second deviation by a predetermined F/B gain or by similar calculations, and which is used for various arithmetic operations (e.g. the arithmetic of addition, subtraction, multiplication and division) with the basic fuel injection amount.

Alternatively, the second F/B controlled variable may be a controlled variable used for the correction of the first F/B controlled variable described above. For example, the second F/B controlled variable may be a correction amount by which the output value of the first air-fuel ratio sensor (the first output value) for defining the first F/B controlled variable is corrected to the lean air-fuel ratio side or the rich air-fuel ratio side, or may be a correction amount by which the first F/B controlled variable is corrected. As described above, if the first output value or the first F/B controlled variable is corrected, the first F/B controlled variable is determined while the first F/B controlled variable includes an element for making the second output value converge on the second target value, which results in a desirable fuel injection amount.

Hereinafter, the control associated with the correction of the fuel injection amount based on the first F/B controlled variable will be expressed as "first F/B control" as occasion demands, and the control associated with the direct or indirect correction of the fuel injection amount based on the second F/B controlled variable will be expressed as "second F/B control" as occasion demands. The first and second F/B controls are included in the action of the controlling device of the present invention. The detailed aspect of the F/B control as described above is ambiguous; however, qualitatively, the basic fuel injection amount is corrected, directly or indirectly, to the side that the fuel injection amount decreases (i.e. to the lean air-fuel ratio side) if the sensor output is on the richer air-fuel ratio side (i.e. the lower air-fuel ratio side) than the target value, and to the side that the fuel injection amount increases (i.e. to the rich air-fuel ratio side) if the sensor output value is on the leaner air-fuel ratio side (i.e. the higher air-fuel ratio side) than the target value.

Particularly in the control apparatus for the internal combustion engine of the present invention, the second air-fuel ratio sensor on the downstream side of the catalyst is a sensor which has linear detectability in a broad air-fuel ratio region including the theoretical air-fuel ratio and which is different from the conventional oxygen concentration sensor. Moreover, since the catalyst functions as a type of buffer, the gas state of an exhaust gas which is a detection target of the second air-fuel ratio sensor is stable in both flow velocity and uniformity, in comparison with the gas state on the upstream side of the catalyst. From these points, the air-fuel ratio on the downstream side of the catalyst which is detected by the second air-fuel ratio sensor has high reliability. The present invention is useful in that the air-fuel ratio within the catalyst can be accurately controlled because the second F/B controlled variable is determined with high reliability.

By the way, for some reasons, if there is a cylinder in which fuel is injected by an amount more than a final injection amount determined by the controlling device, the air-fuel ratio in the exhaust passage is rich. Normally, the change in the air-fuel ratio due to the air-fuel ratio imbalance among the cylinders as described above is suppressed by the first F/B control in which the fuel injection amount is corrected to the lean air-fuel ratio side as a whole.

In reality, however, if there is imbalance which leads to the exhaust air-fuel ratio to the rich side as described above, hydrogen generated in the cylinder having the rich air-fuel ratio tends to be unnecessarily detected on the first air-fuel ratio sensor, and the first output value easily deteriorates to the richer side than an actual air-fuel ratio. In other words, the rich shift of the first output value easily occurs in the first air-fuel ratio sensor. If there is the rich shift, there is an excess shift to the lean air-fuel ratio side in the first F/B control, and the air-fuel ratio in the exhaust passage likely deviates from a target air-fuel ratio to deteriorate the emission.

In order to solve the problem as described above, the control apparatus for the internal combustion engine of the present invention is configured such that the second F/B controlled variable is corrected by the correcting device. In other words, the correcting device corrects the second F/B controlled variable in a binary, stepwise, or continuous manner in the direction in which there is hardly the change of the fuel injection amount to the lean air-fuel ratio side, according to the output deviation between the first air-fuel ratio sensor and the second air-fuel ratio sensor, if the air-fuel ratio imbalance among the cylinders is detected by the detecting device. The "output deviation" is to the effect that it is not simply limited to the deviation of the output value, but conceptually includes a deviation between various index values in the same dimension which are derived from the output value.

The "change of the fuel injection amount to the lean air-fuel ratio side" namely means a change to the side that the ratio of fuel with respect to the air is reduced, and means a change to the side that the fuel injection amount decreases in the case of the same air amount, and means a change to the side that the air amount increases in the case of the same fuel amount. Therefore, the correction of the second F/B controlled variable performed "in the direction in which there is hardly the change of the fuel injection amount to the lean air-fuel ratio side" means correction for reducing a reduction range of the ratio of fuel with respect to the air, or correction for increasing the ratio of fuel with respect to the air.

As described above, in the second F/B control, the fuel injection amount is corrected, directly or indirectly, to the lean side (to the side that an excess fuel ratio decreases) if an atmosphere on the downstream side of the catalyst is on the rich side (an excess fuel side) with respect to the target value, and to the rich side (to the side that an excess air ratio decreases) if the atmosphere is on the lean side (an excess air side).

Therefore, if the air-fuel ratio on the downstream side of the catalyst becomes rich due to the exhaust gas having the rich air-fuel ratio caused by the air-fuel ratio imbalance, the second F/B control acts to correct the fuel injection amount to the lean air-fuel ratio side. If the correction of the fuel injection amount to the lean air-fuel ratio by the second F/B control overlaps the correction of the fuel injection amount to the excessively lean side by the first F/B control caused by the rich shift described above, there is a possibility that the exhaust gas becomes an excessively lean atmosphere, thereby deteriorating the emission.

In anticipation of the aforementioned points, the correcting device is configured such that the amount of correction of the fuel injection amount to the lean air-fuel ratio side by the second F/B control is covered or compensated for by the amount of excess correction of the fuel injection amount to the lean air-fuel ratio by the first F/B control caused by the rich shift.

Therefore, according to the control apparatus for the internal combustion engine of the present invention, it is possible to maintain the air-fuel ratio on the downstream side of the catalyst at the target value all the time, and to preferably suppress the emission deterioration.

There is no guarantee of 100% rich shift due to the air-fuel ratio imbalance; however, the rich shift is a phenomenon caused by the hydrogen generated due to the air-fuel ratio imbalance. Therefore, there is little influence even if the detection of the rich shift is replaced by the detection of the air-fuel ratio imbalance.

There are various practical aspects when the detecting device detects the imbalance, and the present invention does not require the limitation of a detection method. For example, the air-fuel ratio imbalance among the cylinders can be determined by the time transition of the first output value, as a simple method. For example, if the air-fuel ratio of the exhaust gas from a particular cylinder is different from that of another cylinder, it can be determined that there is the air-fuel ratio imbalance among the cylinders.

More specifically, the air-fuel ratio imbalance may be detected on the basis of an index value, such as an imbalance degree which can be determined in advance as the extent of the imbalance. Here, the "air-fuel ratio imbalance degree" is a quantitative index meaning the extent of the air-fuel ratio imbalance among the plurality of cylinders, and the practical aspect thereof is ambiguous in the relevant conceptual range. The air-fuel ratio imbalance degree may be a value determined for the internal combustion engine, or may be values determined for the respective cylinders, according to a practical definition. For example, the "air-fuel ratio imbalance degree" can include values defined in the following (1) to (4). The following expression, "value corresponding to . . . ", conceptually includes a controlled variable, physical quantity, or index value which can have an unambiguous relation with an object value.

(1) a value corresponding to the percentage of the air-fuel ratio of each cylinder, with respect to an average value of the air-fuel ratios of all the cylinders;

(2) a value corresponding to the percentage of the air-fuel ratio of a particular cylinder, with respect to the air-fuel ratio of the remaining cylinder(s);

(3) a value corresponding to the percentage of a deviation between the target air-fuel ratio and the air-fuel ratio of each cylinder, with respect to the target air-fuel ratio; and (4) a value corresponding to the percentage of the air-fuel ratio of each cylinder, with respect to the target air-fuel ratio.

In one aspect of the control apparatus for the internal combustion engine of the present invention, the correcting device corrects the second F/B controlled variable such that the fuel injection amount further increases in comparison with a case where the correction is not performed (Second Item).

According to this aspect, the correcting device corrects the second F/B controlled variable such that the fuel injection amount further increases in comparison with the case where the correction of the second F/B controlled variable is not performed. It is therefore possible to preferably reduce an influence of the rich shift of the first air-fuel ratio sensor.

The second F/B controlled variable may be, as described above, a controlled variable by which the fuel injection amount is directly corrected, or a controlled variable by which the fuel injection amount is indirectly corrected by correcting the first air-fuel ratio detected by the first air-fuel ratio sensor, or a controlled variable by which the fuel injection amount is indirectly corrected by correcting the first F/B controlled variable. In association with the change in the correction aspect as described above, the actual form which can be adopted by the second F/B controlled variable may be various.

In another aspect of the control apparatus for the internal combustion engine of the present invention, the detecting device detects the air-fuel ratio imbalance on the basis of the output deviation (Third Item).

The exhaust gas purifying catalyst has an oxygen storage capacity (OSC), and if an oxygen storage amount (OSA) exceeds the maximum value defined by the OSC, the air-fuel ratio on the downstream side becomes lean because the oxygen that cannot be stored blows to the downstream side of the catalyst. Moreover, if the OSA falls below the minimum value defined by the OSC, the air-fuel ratio on the downstream side becomes rich because the oxidation reaction on the catalyst hardly proceeds. On the other hand, the lean/rich change in the range of the OSC of the catalyst does not directly influence the air-fuel ratio on the downstream side of the catalyst.

Therefore, even if the air-fuel ratio detected on the upstream side of the catalyst changes due to the air-fuel ratio imbalance, the air-fuel ratio on the downstream side of the catalyst does not change in a reasonable period. Therefore, the output deviation between the first air-fuel ratio sensor and the second air-fuel ratio sensor is effective as a reference value for detecting the air-fuel ratio imbalance. For example, in a case where a control target air-fuel ratio is the theoretical air-fuel ratio, if there is no air-fuel ratio imbalance among the cylinders, the air-fuel ratio on the upstream and downstream of the catalyst is ideally maintained at the theoretical air-fuel ratio by the aforementioned first and second F/B controls. On the other hand, even if the air-fuel ratio detected on the upstream side of the catalyst changes to the rich side by a certain degree of amount or in a certain degree of time due to the air-fuel ratio imbalance, the air-fuel ratio on the downstream side of the catalyst does not significantly change. Thus, in this case, the output deviation changes regardless of the definition thereof. In other words, if an appropriate criterion is provided for the treatment of the output deviation, it is possible to preferably detect the air-fuel ratio imbalance among the cylinders which leads to the rich shift of the first air-fuel ratio sensor.

Moreover, since there is a time delay until the air-fuel ratio on the downstream side of the catalyst changes, the correction by the correcting device is already active at a time point at which the air-fuel ratio on the downstream of the catalyst actually changes, and the excessive F/B to the lean air-fuel ratio side can be suppressed.

In another aspect of the control apparatus for the internal combustion engine of the present invention, the correcting device corrects the second F/B controlled variable by correcting an element value which constitutes the second F/B controlled variable, the element value is stored on a standard map and a correction map each of which is associated with the second deviation, the standard map corresponding to a case where the first output value does not deviate to a rich air-fuel ratio side with respect to an actual air-fuel ratio, the correction map corresponding to a case where the first output value deviates to the rich air-fuel ratio side with respect to the actual air-fuel ratio, the second determining device determines the second F/B controlled variable by selecting the element value corresponding to the second deviation from the standard map, and the correcting device corrects the second F/B controlled variable by selecting the element value corresponding to the second deviation from the correction map (Fourth Item).

According to this aspect, the element value of the second F/B controlled variable is stored on the standard map which is to be used in the normal case where there is no rich shift and the correction map which is to be used in an abnormal case where there is the rich shift. The maps are control maps which can be stored in various memory devices such as, for example, a ROM, and which can be referred to by each of the correcting device and the second determining device, as occasion demands.

The element value conceptually includes a value which constitutes the second F/B controlled variable, and which is not limited as long as a change in the element value can promote a change in the second F/B controlled variable. Considering that the second F/B control is the F/B control, the element value can preferably include a correction coefficient such as a correction coefficient of a F/B gain, a learning value of the second F/B controlled variable, and the like. The learning value is a value updated by a learning process as occasion demands. For example, if the F/B control is performed as PID control, PI control, or the like, then, the learning value may be a value corresponding to a steady component derived from an I term (integral term) or the like.

According to this aspect, the second determining device selects the standard map in the normal case, selects the element value from the standard map, and thus can determine the second F/B controlled variable. Moreover, the correcting device selects the correction map in the abnormal case, selects the element value from the correction map, and replaces the second F/B controlled variable to be applied in the normal case. In other words, as the action of the correction device, a similar process to that of the second determining device may be performed by selecting a relevant value from the correction map, and this reduces a load associated with the correction of the second F/B controlled variable.

The correction map may be single map, or a plurality of maps to be changed in stages according to the output deviation.

In one aspect of the control apparatus for the internal combustion engine of the present invention in which the map is used to correct the second F/B controlled variable, in the standard map, the element value in the case where the second deviation is in a rich air-fuel ratio side region with respect to a reference value and the element value in the case where the second deviation is in a lean air-fuel ratio side region with respect to the reference value have a symmetric relation in which the element values have different signs, and the correction map is a map in which the element value in the case where the second deviation is in the rich air-fuel ratio side region with respect to the reference value and the element value in the case where the second deviation is in the lean air-fuel ratio side region with respect to the reference value have an asymmetric relation, by changing, in the standard map, the element value in the rich air-fuel ratio side region with respect to the reference value in a direction in which sensitivity to the second deviation decreases (Fifth Item).

According to this aspect, in the normal map, the element values for the second deviation are symmetric values having different signs, and are configured such that the correction to the lean side and the correction to the rich side are equivalently performed. On the other hand, in the correction map, the element values for the second deviation have different signs and are asymmetric between the rich side and the lean side. Specifically, the correction map is a map in which the sensitivity of the element value to the second deviation is reduced (e.g. corresponding to a map in which a slope is reduced, or a height is reduced, if the element value is on a vertical axis and the second deviation is on a horizontal axis) if the second deviation is on the rich air-fuel ratio side with respect to the reference value (normally, a value corresponding to the theoretical air-fuel ratio).

By virtue of such a configuration, it is possible to reduce the influence of the rich shift of the first air-fuel ratio sensor caused by the hydrogen due to the air-fuel ratio imbalance.

In another aspect of the control apparatus for the internal combustion engine of the present invention, each of the first and second target values is a value corresponding to a theoretical air-fuel ratio (Sixth Item).

According to this aspect, the air-fuel ratio on the downstream side of the catalyst can be maintained at the theoretical air-fuel ratio as much as possible.

In another aspect of the control apparatus for the internal combustion engine of the present invention, the correcting device corrects the second F/B controlled variable in a direction of suppressing the change of the fuel injection amount to the lean air-fuel ratio side if the output deviation indicates that the first output value is on a rich air-fuel ratio side by a predetermined value or more with respect to the second output value (Seventh Item).

According to this aspect, the rich shift of the first air-fuel ratio sensor can be simply detected by providing the output deviation with an appropriate threshold value. Incidentally, the expression "on the rich air-fuel ratio side by the predetermined value or more" includes that "a value obtained by subtracting an air-fuel ratio on the downstream side of the catalyst from an air-fuel ratio on the upstream side of the catalyst is negative"; however, significant figures and other practical matters to be considered are not particularly limited but may be flexible.

In another aspect of the control apparatus for the internal combustion engine of the present invention, the output deviation includes any one of (1) a deviation between the first output valued and the second output value, (2) a deviation between a peak value of the first output value and a peak value of the second output value, (3) a deviation between an average value of the first output value and an average value of the second output value, and (4) a deviation between a response speed of the first air-fuel ratio sensor and a response speed of the second air-fuel ratio sensor (Eighth Item).

Those are reasonable and appropriate as practical aspects of the output deviation.

For example, in the case of (1), control faithful to an actual phenomenon is expected due to the direct comparison of the output values. In the case of (2), an effect to be safe is expected due to the comparison of the peak values (which are obviously peak values in a certain set period). In the case of (3), high reliability is expected, with an influence of noise and gas homogeneity eliminated. In the case of (4), correction independent on the output value is possible.

In another aspect of the control apparatus for the internal combustion engine of the present invention, the correcting device corrects a gain by which the second deviation is to be multiplied, or a learning value of the second controlled variable (Ninth Item).

The gain and the learning value of this type are reasonable as an element (equivalent to the element value described above) which constitutes the second F/B controlled variable which is a F/B controlled variable, and are reasonable as the correction target of the correcting device.

The operation and other advantages of the present invention will become more apparent from an embodiment explained below.

DESCRIPTION OF EMBODIMENT

Embodiment of the Invention

Hereinafter, with reference to the drawings, an embodiment of the present invention will be explained.

<Configuration of Embodiment>

Figure 1:
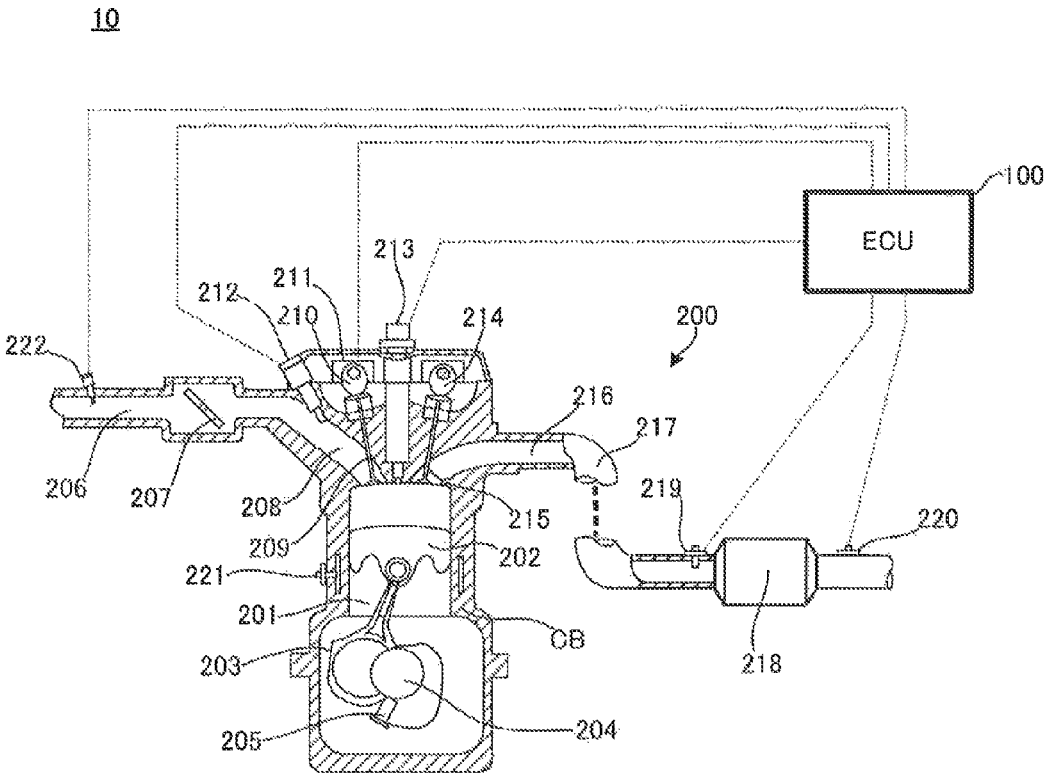
FIG. 1 is a schematic configuration diagram conceptually illustrating a configuration of an engine system in an embodiment of the present invention.

Firstly, with reference to FIG. 1, a configuration of an engine system 10 in the embodiment of the present invention will be explained. FIG. 1 is a schematic configuration diagram conceptually illustrating the configuration of the engine system 10.

In FIG. 1, the engine system 10 is mounted on a not-illustrated vehicle, and is provided with an ECU 100 and an engine 200.

The ECU 100 is provided with a CPU, a ROM, a RAM and the like, and is an electronic control unit configured to control the operation of the engine system 10. The ECU 100 is one example of the "control apparatus for the internal combustion engine" of the present invention. The ECU 100 is configured to perform air-fuel ratio F/B control described later, in accordance with a control program stored in the ROM.

The ECU 100 is an integrated electronic control unit configured to function as one example of each of the "first determining device", the "second determining device", the "controlling device", the "detecting device", and the "correcting device" of the present invention. The physical, mechanical and electrical configurations of each of the devices of the present invention, however, are not limited to this example, and each of the devices may be also configured as various computer systems or the like such as, for example, a plurality of ECUs, various processing units, various controllers, or micro computer apparatuses.

The engine 200 is a multi-cylinder gasoline engine, which is one example of the "internal combustion engine" of the present invention.

In FIG. 1, the engine 200 is provided with a plurality of cylinders 201 contained in a cylinder block CB. In FIG. 1, the cylinders 201 are arranged in a depth direction of the paper, and only one cylinder 201 is illustrated in FIG. 1.

In the engine 200, a combustion chamber formed inside the cylinder 201 is provided with a piston 202 which produces a reciprocating motion in a vertical direction in the drawing according to explosive power caused by the combustion of an air-fuel mixture. The reciprocating motion of the piston 202 is converted into a rotational motion of a crankshaft 204 via a connecting rod 203, and is used as the power of the vehicle on which the engine 200 is mounted.

In the vicinity of the crankshaft 204, there is disposed a crank position sensor 205 configured to detect a rotational position of the crankshaft 204 (i.e. a crank angle). The crank position sensor 205 is electrically connected to the ECU 100. The detected crank angle is referred to by the ECU 100 with a regular or irregular period, and is used, for example, for the calculation of the engine's rotation number NE and for the other control.

In the engine 200, an air flowing from the exterior (or intake air) is purified by a not-illustrated cleaner and is then supplied to an intake tube 206 which is common to the cylinders. In the intake tube 206, there is disposed a throttle valve 207 configured to adjust an intake air amount which is the amount of the intake air. The throttle valve 207 is configured as a type of electronically controlled throttle valve whose driving state is controlled by a not-illustrated throttle valve motor which is electrically connected to the ECU 100.

The ECU 100 performs drive control of the throttle valve motor, basically to obtain a throttle opening degree according to an accelerator opening degree Ta detected by a not-illustrated accelerator position sensor. The ECU 100 can also adjust the throttle opening degree without a driver's intention via motion control of the throttle valve motor.

The intake air adjusted by the throttle valve 207 as occasion demands is supplied through an intake port 208 corresponding to each cylinder 201 to the inside of the cylinder 201 upon opening of an intake valve 209. The intake valve 209 is configured such that the opening/closing timing thereof is determined according to the cam profile of a cam 210 having a cross-sectionally substantially oval shape as illustrated.

On the other hand, the cam 210 is fixed to an intake cam shaft (whose reference numeral is omitted) coupled with the crankshaft 204 via a power transmitting device such as, for example, a cam sprocket and a timing chain. Therefore, the opening/closing phase of the intake valve 209 has an unambiguous relation, in one fixed state, with the rotational phase of the crankshaft 204 (i.e. the crank angle).

Here, the fixed state between the intake cam 210 and the intake cam shaft varies depending on the hydraulic pressure of control oil supplied by a hydraulic pressure driving apparatus 211. More specifically, the intake cam 210 is coupled with the intake cam shaft via a wing-shaped member referred to as a vane, and the rotational phase of the vane and the intake cam shaft is configured to vary depending on the hydraulic pressure applied to a hydraulic chamber of the hydraulic pressure driving apparatus 211. Therefore, the rotational phase of the intake cam 210 fixed to the vane and the intake cam shaft also varies depending on the hydraulic pressure. The hydraulic pressure driving apparatus 211 is electrically connected to the ECU 100, and the ECU 100 can change the opening/closing timing of the intake valve 209 through the control of the hydraulic pressure driving apparatus 211.

The intake air supplied to the intake port 208 is mixed with fuel (gasoline in the embodiment) injected from an intake port injector 212 in which an injection valve is partially exposed to the intake port 208, to make the aforementioned air-fuel mixture. The gasoline as the fuel is stored in a not-illustrated fuel tank, and is supplied to the intake port injector 212 via a not-illustrated delivery pipe by the action of a not-illustrated low pressure feed pump. In the intake port injector 212, a not-illustrated driving apparatus which drives the injection valve is electrically connected to the ECU 100. Due to that the ECU 100 controls a valve opening period of the injection valve via this driving apparatus, the intake port injector 212 can supply the intake port 208 with an amount of fuel spray according to the valve opening period.

In the combustion chamber of the engine 200, there is partially exposed a spark plug (whose reference numeral is omitted) of an ignition apparatus 213, which is a spark ignition apparatus. The air-fuel mixture compressed in a compression stroke of the engine 200 is ignited and burned by an ignition operation of the spark plug. The ignition apparatus 213 is electrically connected to the ECU 100, and the ignition timing of the ignition apparatus 213 is controlled by the ECU 100.

On the other hand, the air-fuel mixture which causes the combustion reaction in the combustion chamber flows out to an exhaust port 216 upon opening of the exhaust valve 215, when the exhaust valve 215, which is subject to opening/closing drive in accordance with opening/closing timing determined according to the cam profile of an exhaust cam 214 which is indirectly coupled with the crankshaft 204, is opened in an exhaust stroke subsequent to a combustion stroke.

An exhaust tube 217 is coupled with the exhaust port 216 in each cylinder via a not-illustrated exhaust manifold. The exhaust tube 217 is one example of the "exhaust passage" of the present invention.

In the exhaust tube 217, there is disposed a three-way catalyst 218 which is one example of the "exhaust gas purifying catalyst" of the present invention. The three-way catalyst 218 is a known catalyst apparatus in which noble metal such as platinum is carried on a catalyst support, and is configured to purify the exhaust gas by allowing the oxidation combustion of HC and CO and the reduction of nitrogen oxide NOx to proceed at substantially the same time.

On the upstream side of the three-way catalyst 218 in the exhaust tube 217, there is disposed a first air-fuel ratio sensor 219 configured to detect an upstream side air-fuel ratio A/Fin which is the air-fuel ratio of a catalyst inflow gas which flows into the three-way catalyst 218. The first air-fuel ratio sensor 219 is, for example, a wide range air-fuel ratio sensor of a limiting current type provided with a diffusion resistance layer, and is one example of the "first air-fuel ratio sensor" of the present invention.

The first air-fuel ratio sensor 219 is a sensor configured to output an output voltage value Vf (i.e. one example of the "first output value" of the present invention) according to the upstream side air-fuel ratio A/Fin. In other words, the first air-fuel ratio sensor 219 is configured to indirectly detect the input side air-fuel ratio A/Fin from a voltage value having an unambiguous relation with the upstream-side air-fuel ratio A/Fin.

The output voltage value Vf is equal to a reference output voltage value Vst when the upstream side air-fuel ratio A/Fin is the theoretical air-fuel ratio. The output voltage value Vf is lower than the reference output voltage value Vst if the upstream side air-fuel ratio A/Fin is on the rich air-fuel ratio side, and is higher than the reference output voltage value Vst if the upstream side air-fuel ratio A/Fin is on a lean air-fuel ratio side. In other words, the output voltage value Vf continuously changes with respect to a change in the upstream side air-fuel ratio A/Fin. The first air-fuel ratio sensor 219 is electrically connected to the ECU 100, and the detected output voltage value Vf is referred to by the ECU 100 with a regular or irregular period.

On the downstream side of the three-way catalyst 218 in the exhaust tube 217, there is disposed a second air-fuel ratio sensor 220 configured to detect a downstream side air-fuel ratio A/Fout which is the air-fuel ratio of a catalyst emission gas which flows out from the three-way catalyst 218. The second air-fuel ratio sensor 220 is, for example, a wide range air-fuel ratio sensor of a limiting current type provided with a diffusion resistance layer, and is one example of the "second air-fuel ratio sensor" of the present invention.

The second air-fuel ratio sensor 220 is a sensor configured to output an output voltage value Vr (i.e. one example of the "second output value" of the present invention) according to the downstream side air-fuel ratio A/Fout. In other words, the second air-fuel ratio sensor 220 is configured to indirectly detect the downstream side air-fuel ratio A/Fout from a voltage value having an unambiguous relation with the downstream-side air-fuel ratio A/Fout.

The output voltage value Vr is equal to the reference output voltage value Vst when the downstream side air-fuel ratio A/Fout is the theoretical air-fuel ratio. The output voltage value Vr is lower than the reference output voltage value Vst if the downstream side air-fuel ratio A/Fout is on the rich air-fuel ratio side, and is higher than the reference output voltage value Vst if the downstream side air-fuel ratio A/Fout is on the lean air-fuel ratio side. In other words, the output voltage value Vr continuously changes with respect to a change in the downstream side air-fuel ratio A/Fout. The second air-fuel ratio sensor 220 is electrically connected to the ECU 100, and the detected output voltage value Vr is referred to by the ECU 100 with a regular or irregular period.

In the engine 200, in a water jacket disposed to surround the cylinder block CB, there is disposed a water temperature sensor 221 configured to detect a coolant temperature Tw which is the temperature of a coolant (LLC) circulated and supplied to cool the engine 200. The water temperature sensor 221 is electrically connected to the ECU 100, and the detected coolant temperature Tw is referred to by the ECU 100 with a regular or irregular detection period.

In the engine 200, moreover, in the intake tube 206, there is disposed an airflow meter 222 configured to detect an intake air amount Ga. The airflow meter 222 is electrically connected to the ECU 100, and the detected intake air amount Ga is referred to by the ECU 100 with a regular or irregular detection period.

The engine 200 in the embodiment is a non-supercharged engine which uses gasoline as fuel; however, the internal combustion engine of the present invention is not limited to the engine 200 and may have various configurations. For example, in the internal combustion engine of the present invention, the number of cylinders, cylinder arrangement, fuel types, fuel injection aspects, intake/exhaust system configurations, valve train or system, combustion methods, presence or absence of a supercharger, supercharging aspects and the like may be different from those of the engine 200.

<Operation of Embodiment>

<Outline of Air-Fuel Ratio F/B Control>

In the engine 200, a fuel injection amount Qpfi of the intake port injector 212 is controlled by the ECU 100 in the air-fuel ratio F/B control performed all the time in an operating period of the engine 200.

Figure 2:
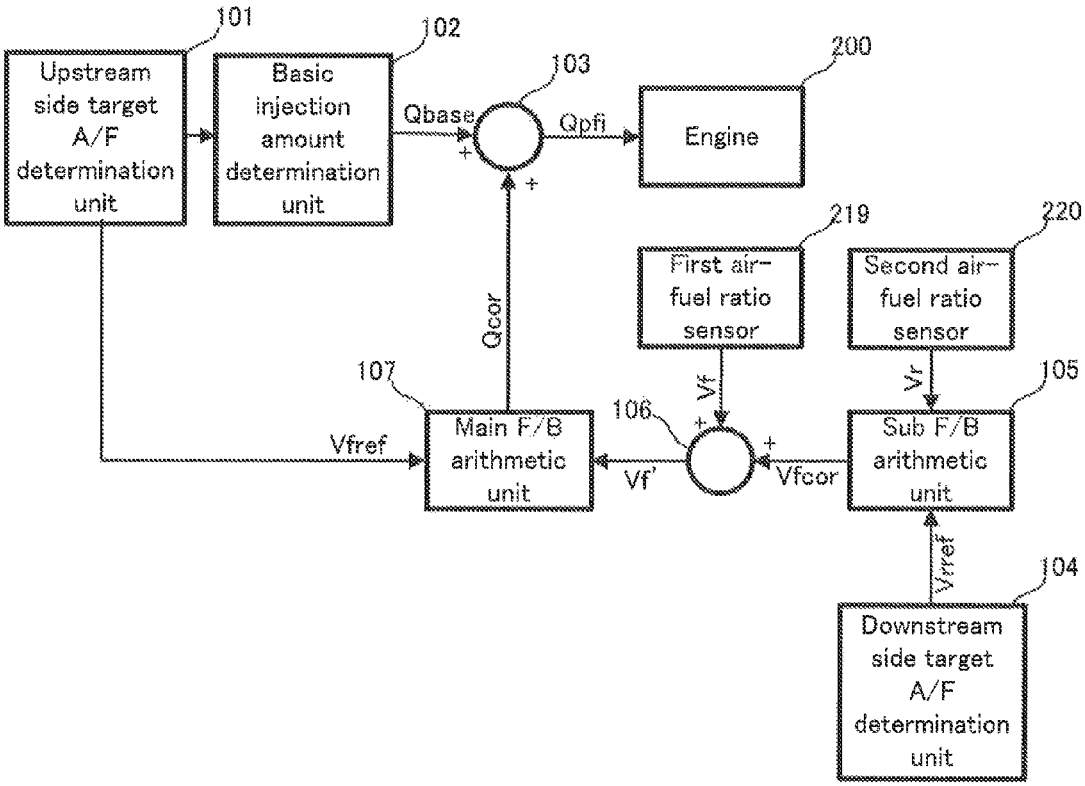
FIG. 2 is a block diagram illustrating an ECU when air-fuel ratio F/B control is performed.

Now, with reference to FIG. 2, a logical configuration of the air-fuel ratio F/B control will be explained. FIG. 2 is a block diagram illustrating the ECU 100 when the air-fuel ratio F/B control is performed. In FIG. 2, a duplicate portion of FIG. 1 will carry the same reference numeral, and the explanation thereof will be omitted.

In FIG. 2, the ECU 100 is provided with control blocks, which are an upstream side target A/F determination unit 101, a basic injection amount determination unit 102, an adder 103, a downstream target A/F determination unit 104, a sub F/B arithmetic unit 105, an adder 106, and a main F/B arithmetic unit 107.

The upstream side target A/F determination unit 101 is a control block which determines an upstream side target air-fuel ratio A/Fintg which is a target air-fuel ratio on the upstream side of the three-way catalyst 218. The upstream side target air-fuel ratio A/Fintg is basically the theoretical air-fuel ratio (14, 6) except for transient operation conditions or the like. From the upstream side target A/F determination unit 101, an upstream side target voltage value Vfref corresponding to the upstream side target air-fuel ratio A/Fintg is outputted. The upstream side target voltage value Vfref is one example of the "first target value" of the present invention.

The basic injection amount determination unit 102 is a control block which determines a basic injection amount Qbase which is the base of the fuel injection amount Qpfi. The basic injection amount Qbase is determined on the basis of the upstream target air-fuel ratio A/Fintg (which may be converted from the upstream side target voltage value Vfref or may be obtained directly from the upstream side target air-fuel ratio determination unit 101) and the intake air amount Ga detected by the airflow meter 222. The determined basic injection amount Qbase is a basic injection amount at a time point at which the intake air whose intake air amount Ga is detected by the airflow meter 222 arrives at the intake port 208. The arrival timing is known on the basis of the crank angle of the engine 200.

Here, the basic injection amount Qbase is corrected by main F/B control and sub F/B control. Specifically, the main F/B control is correction control for the basic injection amount Qbase performed such that the upstream side air-fuel ratio A/Fin detected by the first air-fuel ratio sensor 219 converges on the upstream side target air-fuel ratio A/Fintg. The sub F/B control is correction control for the basic injection amount Qbase performed such that the downstream side air-fuel ratio A/Fout detected by the second air-fuel ratio sensor 220 converges on a downstream side target air-fuel ratio A/Fouttg. The practical aspect of this type of F/B control is ambiguous, and the control in the embodiment described later is merely one example.

Firstly, the sub F/B control will be explained. The sub F/B control is established by the downstream side target air-fuel ratio determination unit 104, the sub F/B arithmetic unit 105 and the adder 106.

The downstream side target air-fuel ratio determination unit 104 is a control block which determines the downstream side target air-fuel ratio A/Fouttg which is a target value of the air-fuel ratio of the gas on the downstream side of the three-way catalyst 218, namely, the catalyst emission gas. The downstream side target air-fuel ratio A/Fouttg is assumed to be basically the theoretical air-fuel ratio (14, 6). The downstream side target air-fuel ratio determination unit 104 outputs a downstream side target voltage value Vrref corresponding to the downstream side target air-fuel ratio A/Fouttg. The downstream side target voltage value Vrref is one example of the "second target value" of the present invention.

The sub F/B arithmetic unit 105 is a control block which calculates a sub F/B controlled variable Vfcor which is a controlled variable for correcting the output voltage value Vf of the first air-fuel ratio sensor 219. The sub F/B controlled variable Vfcor is one example of the "second F/B controlled variable" of the present invention.

The sub F/B controlled variable Vfcor is a value obtained by multiplying the absolute value $|\Delta Vr|$ of a downstream side voltage variation $\Delta Vr$ ($\Delta Vr=Vr-Vrref$), which is a deviation between the output voltage value Vr of the second air-fuel ratio sensor 220 and the downstream side target voltage value Vrref, by a sub F/B gain Gfbr (Gfbr>0) and a sub F/B correction amount Kr1. The sub F/B gain Gfbr is one example of the "element value" of the present invention.

The sub F/B correction amount Kr1 has a negative value if the downstream side voltage deviation $\Delta Vr$ has a negative value (i.e. the downstream side air-fuel ratio A/Fout is on the rich side with respect to the target), and has a positive value if the downstream side voltage deviation $\Delta Vr$ has a positive value (i.e. the downstream side air-fuel ratio A/Fout is on the lean side with respect to the target).

The sub F/B controlled variable Vfcor outputted from the sub F/B arithmetic unit 105 is added to the output voltage value Vf of the first air-fuel ratio sensor 219 on the adder 106, and is outputted to the main F/B arithmetic unit 107 as an upstream side correction output voltage value Vf.

Next, the main F/B control will be explained. The main F/B control is established by the upstream side target air-fuel ratio determination unit 101 and the main F/B arithmetic unit 107.

The main F/B arithmetic unit 107 is a control block which calculates a main F/B controlled variable Qcor which is a controlled variable for correcting the basic fuel injection amount Qbase. The main F/B controlled variable Qcor is one example of the "first F/B controlled variable" of the present invention.

The main F/B controlled variable Qcor is a value obtained by multiplying the absolute value $|\Delta Vf|$ of a upstream side voltage variation $\Delta Vf$ ($\Delta Vf=Vf-Vfref$), which is a deviation between the upstream side correction output voltage value Vf outputted from the adder 106 and the upstream side target voltage value Vfref, by a main F/B gain Gfbf (Gfbf>0) and a main F/B correction amount Kf1.

According to the main F/B control, if the correction output voltage value Vf is on the rich side with respect to the target, the main F/B controlled variable Qcor has a negative value and the basic injection amount Qbase is corrected to the decreasing side. As a result, the air-fuel ratio of the catalyst inflow gas (the upstream side air-fuel ratio A/Fin) is corrected to the lean side. On the other hand, if the correction output voltage value Vf is on the lean side with respect to the target, the main F/B controlled variable Qcor has a positive value and the basic injection amount Qbase is corrected to the increasing side. As a result, the air-fuel ratio of the catalyst inflow gas (the upstream side air-fuel ratio A/Fin) is corrected to the rich side.

Now, the correction output voltage value Vf will be briefly explained.

If the downstream side air-fuel ratio A/Fout is on the rich side with respect to the target, the sub F/B correction amount Kr1 has a negative value, and the sub F/B controlled variable Vfcor thus has a negative value. Therefore, the correction output voltage value Vf is corrected to the richer side than the output voltage value Vf of the first air-fuel ratio sensor 219. This results in strong correction to the lean side by the main F/B controlled variable Qcor in the main F/B control described above.

On the other hand, if the downstream side air-fuel ratio A/Fout is on the lean side with respect to the target, the sub F/B correction amount Kr1 has a positive value, and the sub F/B controlled variable Vfcor thus has a positive value. Therefore, the correction output voltage value Vf is corrected to the leaner side than the output voltage value Vf of the first air-fuel ratio sensor 219. This results in strong correction to the rich side by the main F/B controlled variable Qcor in the main F/B control described above.

In other words, the sub F/B control in the embodiment is control for correcting the output voltage value of the first air-fuel ratio sensor 219 in order to make the air-fuel ratio of the catalyst emission gas (i.e. the downstream side air-fuel ratio A/Fout) converge on the downstream side target air-fuel ratio A/Fouttg. To put it differently, the sub F/B control is incorporated as a portion of the main F/B control.

The practical aspect of the main F/B control and the sub F/B control is ambiguous as described above. For example, the sub F/B control may not be the control for correcting the output voltage value Vf of the first air-fuel ratio sensor 219 as described above but may be control for correcting the upstream side target air-fuel ratio A/Fintg, or may be control for directly correcting the basic injection amount Qbase. In any case, good controllability is given to the air-fuel ratio of the catalyst emission gas by disposing the second air-fuel ratio sensor 220 configured to linearly detect the downstream side air-fuel ratio A/Fout, on the downstream side of the three-way catalyst 218

<Details of Air-Fuel Ratio F/B Control>

Figure 3:
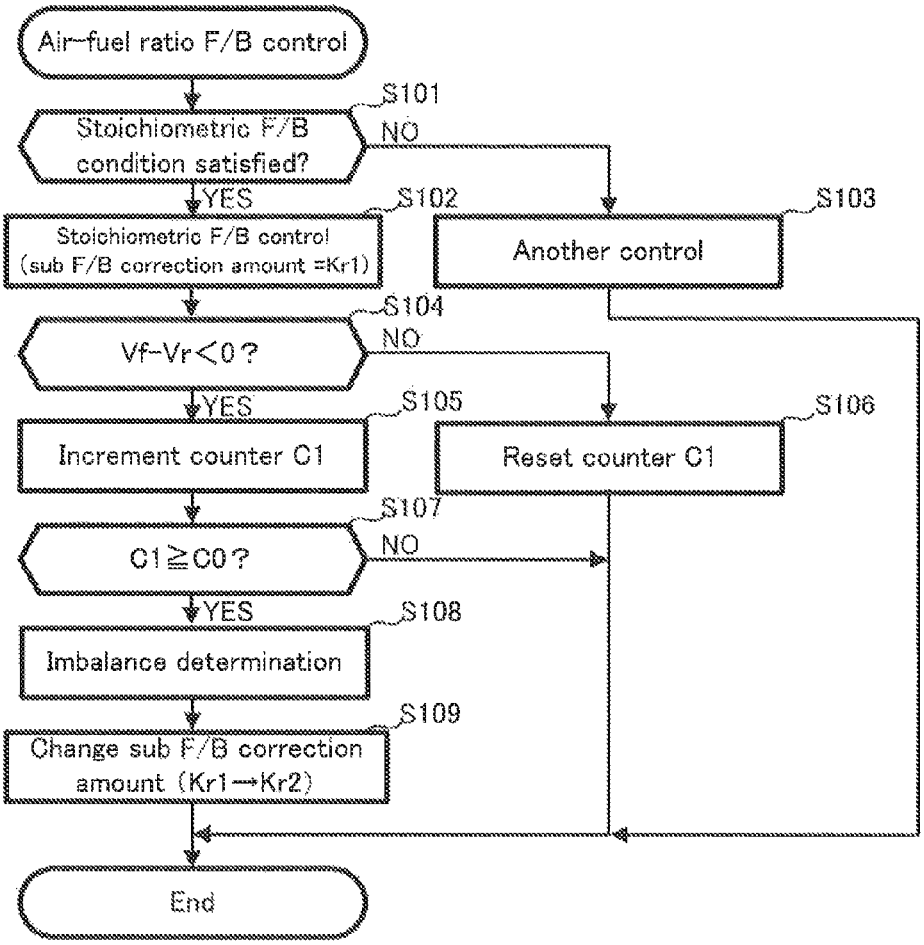
FIG. 3 is a flowchart illustrating the air-fuel ratio F/B control in FIG. 2.

Next, with reference to FIG. 3, the details of the air-fuel ratio F/B control will be explained. FIG. 3 is a flowchart illustrating the air-fuel ratio F/B control.

In FIG. 3, the air-fuel ratio F/B control is performed as one sub routine of fuel injection control performed by the ECU 100 on an upper stream.

In the air-fuel ratio F/B control, firstly, it is determined whether or not a stoichiometric F/B condition is satisfied (step S101). The stoichiometric F/B condition is a condition in which each of the upstream side target air-fuel ratio A/Fintg and the downstream side target air-fuel ratio A/Fouttg is the theoretical air-fuel ratio. The condition as described above is determined in advance according to operating conditions of the engine 200 or the vehicle on which the engine 200 is mounted.

If the stoichiometric F/B condition is not satisfied (the step S101: NO), the ECU 100 moves the processing to a step S103 and performs another control. Another control is a general term of the sub routine that is different from the air-fuel ratio F/B control, and is not mentioned here.

If the stoichiometric F/B condition is satisfied (the step S101: YES), the ECU 100 performs the stoichiometric F/B control (step S102). The stoichiometric F/B control is the air-fuel ratio F/B control whose control blocks are exemplified in FIG. 2. In the stoichiometric F/B control, the sub F/B correction amount described above is set to Kr1.

Figure 4:
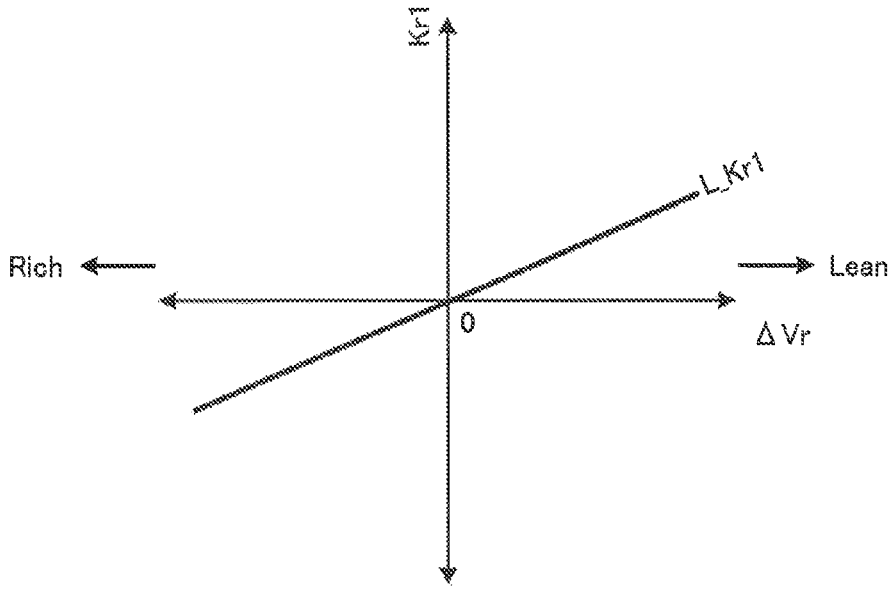
FIG. 4 is a conceptual diagram illustrating a standard map referred to in the air-fuel ratio F/B control in FIG. 2.

In the step S102, a standard map which is one of control maps stored in the ROM is used, and the sub F/B correction amount Kr1 is set. Now, with reference to FIG. 4, the standard map will be explained. FIG. 4 is a conceptual diagram illustrating the standard map.

In FIG. 4, the standard map describes that the sub F/B correction amount Kr1 has a relation of characteristic L_Kr1 (solid line)

Specifically, if the downstream side voltage deviation ΔVr (i.e. one example of the "output deviation" of the present invention) is on the horizontal axis and the sub F/B correction amount Kr1 is on the vertical axis, the sub F/B correction amount Kr1 has a negative value in a negative value region (i.e. a rich air-fuel ratio region) on the left side of the origin (i.e. a state in which the downstream side air-fuel ratio A/Fout is the theoretical air-fuel ratio), and has a positive value in a positive value region (i.e. a lean air-fuel ratio region) on the right of the origin. The absolute value of the sub F/B correction amount Kr1 has a linear relation with the absolute value of the downstream side voltage deviation ΔVr, and the sub F/B correction amount Kr1 is symmetric on the rich air-fuel ratio side and the lean air-fuel ratio side.

Here, the sub F/B correction amount Kr1 has a relation of linearly changing with respect to the downstream side voltage deviation ΔVr, and F/B is stronger as the downstream side air-fuel ratio A/Fout deviates more from the target; however, this is one example. For example, the sub F/B correction amount Kr1 may have a relation of changing in stages with respect to the downstream side voltage deviation ΔVr, or may have a constant fixed value.

Back in FIG. 3, in the process in which the stoichiometric F/B control is performed, the ECU 100 determines whether or not a deviation between the upstream side output voltage value Vf and the downstream side output voltage value Vr has a negative value, i.e. whether or not the catalyst inflow gas has a relatively rich air-fuel ratio in comparison with the catalyst emission gas (step S104). If the catalyst emission gas has a richer air-fuel ratio, or if the catalyst inflow gas has an air-fuel ratio equal to that of the catalyst emission gas (the step S104: NO), the ECU 100 resets a counter C1 (step S106) and ends the air-fuel ratio F/B control. As described above, the air-fuel ratio F/B control is a type of sub routine. Thus, even if the air-fuel ratio F/B control is ended once, the air-fuel ratio F/B control is performed again from the step S101 if an execution condition is satisfied in a not-illustrated main routine.

If the catalyst inflow gas has a relatively rich air-fuel ratio (the step S104: YES), the ECU 100 increments the counter C1 (step S105), and determines whether or not the counter C1 is greater than or equal to an imbalance determination value C0 (step S107). The imbalance determination value C0 is a value adapted experimentally in advance. If the counter C1 is less than the imbalance determination value C0 (the step S107: NO), the ECU 100 ends the air-fuel ratio F/B control.

On the other hand, during the continued situation that the upstream side air-fuel ratio A/Fin is less than the downstream side air-fuel ratio A/Fout (i.e. the catalyst inflow gas has a relatively rich air-fuel ratio), if the counter C1 which is incremented as occasion demands becomes greater than or equal to the imbalance determination value C0 (the step S107: YES), the ECU 100 determines that there is air-fuel ratio imbalance among the plurality of cylinders of the engine 200 (step S108). In other words, in this case, the ECU 100 functions as one example of the "detecting device" of the present invention.

If it is determined that there is the air-fuel ratio imbalance, the ECU 100 changes the sub F/B correction amount described above from Kr1 to Kr2 and corrects the sub F/B controlled variable Vfcor, under the determination that there is a rich shift in the first air-fuel ratio sensor 219 (step S109). The sub F/B correction amount Kr2 is described in a correction map stored in the ROM. The ECU 100 changes a map for selecting the sub F/B correction amount from the previous standard map to the correction map, and selects the sub F/B correction amount Kr2. If the sub F/B correction amount is changed, the air-fuel ratio F/B control is ended.

Figure 5:
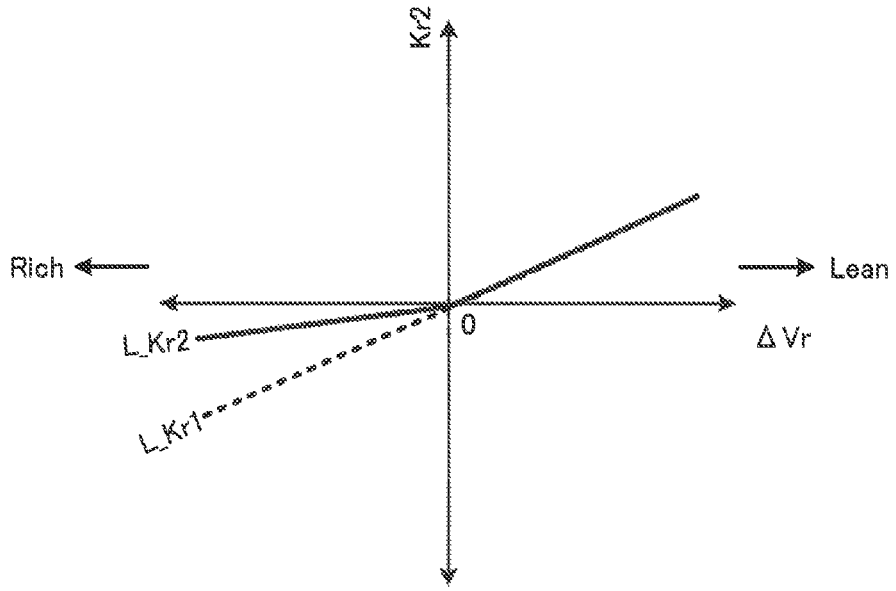
FIG. 5 is a conceptual diagram illustrating a correction map to referred to in the air-fuel ratio F/B control in FIG. 2.

Now, with reference to FIG. 5, the correction map will be explained. FIG. 5 is a conceptual diagram illustrating the correction map. In FIG. 5, a duplicate portion of FIG. 4 will carry the same reference numeral, and the explanation thereof will be omitted.

In FIG. 5, the correction map describes that the sub F/B correction amount Kr2 has a relation of characteristic L_Kr2 (solid line).

Specifically, if the downstream side voltage deviation ΔVr is on the horizontal axis and the sub F/B correction amount Kr2 is on the vertical axis, the sub F/B correction amount Kr2 has a negative value in a negative value region (i.e. a rich air-fuel ratio region) on the left side of the origin (i.e. a state in which the downstream side air-fuel ratio A/Fout is the theoretical air-fuel ratio), and has a positive value in a positive value region (i.e. a lean air-fuel ratio region) on the right of the origin. The absolute value of the sub F/B correction amount Kr2 has a linear relation with the absolute value of the downstream side voltage deviation ΔVr. These points are the same as those in the standard map illustrated in FIG. 4.

On the other hand, in the correction map, the sub F/B correction amount Kr2 is asymmetric on the rich air-fuel ratio side and the lean air-fuel ratio side (refer to L_Kr1 (dashed line) which is symmetric). In other words, the sub F/B correction amount Kr2 in the rich air-fuel ratio region on the left side of the origin has a smaller slope with respect to the downstream side voltage deviation ΔVr than the sub F/B correction amount Kr2 in the lean air-fuel ratio region on the right side of the origin. To put it differently, sensitivity to the downstream side voltage deviation ΔVr is low.

If the sub F/B correction amount Kr2 is used for the sub F/B control, the correction of the fuel injection amount to the lean side becomes weaker than in the case where the sub F/B correction amount Kr1 is used, in a situation in which the downstream side air-fuel ratio A/Fout indicates a richer side value than the target.

Here, if there is the air-fuel ratio imbalance among the cylinders, hydrogen is generated from the cylinder(s) having the rich air-fuel ratio. The hydrogen has small particles and a high diffusion rate, and the detection terminal of the first air-fuel ratio sensor 219 is thus easily covered with the hydrogen. As a result, the upstream side air-fuel ratio A/Fin detected by the first air-fuel ratio sensor 219 tends to be shifted to the rich side with respect to an average air-fuel ratio of the catalyst inflow gas. In other words, the rich shift easily occurs in the first air-fuel ratio sensor 219.

If there is the rich shift, the upstream side output voltage value Vf in FIG. 2 is excessively deflected to the rich side. Thus, if no measures are taken, the main F/B controlled variable Qcor outputted from the main F/B arithmetic unit 107 becomes an excessively lean-side controlled variable, and the air-fuel ratio of the catalyst inflow gas likely stays on the lean side with respect to the upstream side target air-fuel ratio A/Fintg to deteriorate the emission.

Thus, in the embodiment, if the catalyst emission gas has the rich air-fuel ratio (i.e. if the downstream side output voltage value Vr is less than the downstream side target voltage value Vrref), the sub F/B controlled variable Vfcor which is to be added to the upstream side output voltage value Vf is corrected by the sub F/B correction amount Kr2, so that it makes difficult to correct the fuel injection amount to the lean air-fuel ratio side. As a result, an output change due to the rich shift is canceled by an output change due to the change of the sub F/B correction amount Kr2, by which the emission deterioration can be suppressed.

In the embodiment, the deviation between the upstream side output voltage value Vf and the downstream side output voltage value Vr is used as the "output deviation" of the present invention; however, an aspect which can be adopted by the "output deviation" of the present invention is not limited to this example.

For example, a deviation between the peak value of the upstream side output voltage value Vf in a certain period and the peak value of the downstream side output voltage value Vr in a certain period may be used. Alternatively, a deviation between the average value of the upstream side output voltage value Vf in a certain period and the average value of the downstream side output voltage value Vr in a certain period may be used. If the average value is used, it is possible to perform more accurate and stable imbalance determination. Moreover, instead of the air-fuel ratio equivalent value of each gas as described above, a difference in response speed between the first air-fuel ratio sensor 219 and the second air-fuel ratio sensor 220 may be used. The hydrogen caused by the air-fuel ratio imbalance disappears due to catalyst reaction when passing through the three-way catalyst 218, and its influence appears only on the first air-fuel ratio sensor 219. Therefore, consequently, there is a detectable difference in the response speed between the two sensors.

The embodiment exemplifies that the sub F/B correction amount, which is the correction coefficient of the sub F/B gain Gfbr, is corrected from Kr1 to Kr2 as the action of the correcting device of the present invention; however, this is one example of the action of the correcting device of the present invention.

For example, when the sub F/B arithmetic unit 105 calculates the sub F/B controlled variable Vfcor, various known learning processes can be preferably performed. The learning process is, for example, a process of storing the steady component of the sub F/B controlled variable as a leaning value while the steady component is updated as occasion demands. The learning value is a value which is reflected in the sub F/B controlled variable as one example of the "element value" of the present invention. If the learning value of the sub F/B controlled variable is corrected to the decreasing side in cases where there is the air-fuel ratio imbalance, or in cases where there is the rich shift in the first air-fuel ratio sensor 219 and the downstream side voltage deviation ΔVr is shifted to the rich side, then, it is possible to avoid the excessive correction of the fuel injection amount to the lean air-fuel ratio side in the same manner as described above.

The present invention is not limited to the aforementioned embodiment, but various changes may be made, if desired, without departing from the essence or spirit of the invention which can be read from the claims and the entire specification. A control apparatus for an internal combustion engine, which involves such changes, is also intended to be within the technical scope of the present invention.

INDUSTRIAL APPLICABILITY

The present invention can be applied to the control of the fuel injection amount in the internal combustion engine.

DESCRIPTION OF REFERENCE NUMERALS AND LETTERS

10 engine system
100 ECU
200 engine
CB cylinder block
201 cylinder
212 intake port injector
217 exhaust tube
218 three-way catalyst
219 first air-fuel ratio sensor
222 second air-fuel ratio sensor

The invention claimed is:

1. A control apparatus for an internal combustion engine, configured to control the internal combustion engine, the internal combustion engine comprising:

an exhaust gas purifying catalyst disposed in an exhaust passage;

a first air-fuel ratio sensor disposed on an upstream side of the catalyst and configured to output a first output value according to an air-fuel ratio of a catalyst inflow gas; and a second air-fuel ratio sensor disposed on a downstream side of the catalyst and configured to output a second output value according to an air-fuel ratio of a catalyst emission gas, the control apparatus comprising a controller, the controller being configured to:

determine a first F/B controlled variable for making the first output value converge on a first target value, according to a first deviation which is a deviation between the first output value and the first target value;

determine a second F/B controlled variable for making the second output value converge on a second target value, according to a second deviation which is a deviation between the second output value and the second target value;

control a fuel injection amount of the internal combustion engine on the basis of the determined first F/B controlled variable and the determined second F/B controlled variable;

detect air-fuel ratio imbalance among a plurality of cylinders of the internal combustion engine; and correct the second F/B controlled variable so that the fuel injection amount is less likely to change to a lean air-fuel ratio side by decreasing the second F/B controlled variable compared to a case where the air-fuel ratio imbalance is not detected, according to an output deviation between the first air-fuel ratio sensor and the second air-fuel ratio sensor, if the air-fuel ratio imbalance is detected.

2. The control apparatus for the internal combustion engine according to claim 1, wherein the controller is configured to correct the second F/B controlled variable such that the fuel injection amount further increases in comparison with a case where the correction is not performed.

3. The control apparatus for the internal combustion engine according to claim 1, wherein the controller is configured to detect the air-fuel ratio imbalance on the basis of the output deviation.

4. The control apparatus for the internal combustion engine according to claim 1, wherein the controller is configured to correct the second F/B controlled variable by correcting an element value which constitutes the second F/B controlled variable, the element value is stored on a standard map and a correction map each of which is associated with the second deviation, the standard map corresponding to a case where the first output value does not deviate to a rich air-fuel ratio side with respect to an actual air-fuel ratio, the correction map corresponding to a case where the first output value deviates to the rich air-fuel ratio side with respect to the actual air-fuel ratio, the controller is configured to determine the second F/B controlled variable by selecting the element value corresponding to the second deviation from the standard map, and the controller is configured to correct the second F/B controlled variable by selecting the element value corresponding to the second deviation from the correction map.

5. The control apparatus for the internal combustion engine according to claim 4, wherein in the standard map, the element value in the case where the second deviation is in a rich air-fuel ratio side region with respect to a reference value and the element value in the case where the second deviation is in a lean air-fuel ratio side region with respect to the reference value have a symmetric relation in which the element values have different signs, and the correction map is a map in which the element value in the case where the second deviation is in the rich air-fuel ratio side region with respect to the reference value and the element value in the case where the second deviation is in the lean air-fuel ratio side region with respect to the reference value have an asymmetric relation, by changing, in the standard map, the element value in the rich air-fuel ratio side region with respect to the reference value in a direction in which sensitivity to the second deviation decreases.

6. The control apparatus for the internal combustion engine according to claim 1, wherein each of the first and second target values is a value corresponding to a theoretical air-fuel ratio.

7. The control apparatus for the internal combustion engine according to claim 1, wherein the controller is configured to correct the second F/B controlled variable in a direction of suppressing the change of the fuel injection amount to the lean air-fuel ratio side if the output deviation indicates that the first output value is on a rich air-fuel ratio side by a predetermined value or more with respect to the second output value.

8. The control apparatus for the internal combustion engine according to claim 1, wherein the output deviation includes any one of (1) a deviation between the first output valued and the second output value, (2) a deviation between a peak value of the first output value and a peak value of the second output value, (3) a deviation between an average value of the first output value and an average value of the second output value, and (4) a deviation between a response speed of the first air-fuel ratio sensor and a response speed of the second air-fuel ratio sensor.

9. The control apparatus for the internal combustion engine according to claim 1, wherein the controller is configured to correct a gain by which the second deviation is to be multiplied, or a learning value of the second controlled variable.

* * * * *